US005638791A

United States Patent [19]

Tsuzuki et al.

[11] Patent Number: 5,638,791

[45] Date of Patent: Jun. 17, 1997

[54] COMMON-RAIL FUEL INJECTION SYSTEM FOR AN ENGINE

[75] Inventors: Yoshihiro Tsuzuki, Handa; Toshihiko Igashira, Toyokawa; Yasuyuki Sakakibara, Nishio; Kazuhide Watanabe, Toyohashi, all of Japan

[73] Assignee: Nippon Soken Inc., Nishio, Japan

[21] Appl. No.: 561,067

[22] Filed: Nov. 22, 1995

[30] Foreign Application Priority Data

Dec. 15, 1994 [JP] Japan ..... 6-312042

[51] Int. Cl.[6] ..... F02M 37/04

[52] U.S. Cl. ..... 123/467; 123/458

[58] Field of Search ..... 123/467, 458, 123/506, 446, 456

[56] References Cited

U.S. PATENT DOCUMENTS

| | | | |
|---|---|---|---|
| 4,249,497 | 2/1981 | Eheim | 123/467 |
| 4,545,352 | 10/1985 | Jourde | 123/458 |
| 4,546,749 | 10/1985 | Igashira | 123/458 |
| 4,603,671 | 8/1986 | Yoshinaga | 123/467 |
| 4,640,252 | 2/1987 | Nakamura | 123/467 |
| 4,909,440 | 3/1990 | Mitsuyasu | 123/467 |
| 5,156,132 | 10/1992 | Iwanaga | 123/467 |

FOREIGN PATENT DOCUMENTS 5-332220 12/1993 Japan .

*Primary Examiner*—Carl S. Miller

*Attorney, Agent, or Firm*—Cushman, Darby & Cushman IP Group of Pillsbury Madison & Sutro LLP

[57] ABSTRACT

A common-rail fuel injection system for an engine includes a fuel injector having a nozzle hole. A common rail stores high-pressure fuel. The common rail is connected to the fuel injector to feed the high-pressure fuel thereto. A movable nozzle needle disposed in the fuel injector blocks and unblocks the nozzle hole in accordance with movement thereof. A back pressure control chamber defined in the fuel injector is connected to the common rail to receive the high-pressure fuel therefrom. The nozzle needle is urged in a direction of blocking the nozzle hole in response to a pressure in the back pressure control chamber. A fuel chamber defined in the fuel injector is connected to the common rail to receive the high-pressure fuel therefrom. The nozzle needle is urged in a direction of unblocking the nozzle hole in response to a pressure in the fuel chamber. A fuel-pressure-responsive 2-way valve controls the pressure in the back pressure control chamber. An electromagnetic valve changes a state of the fuel-pressure-responsive 2-way valve. The fuel injector and the fuel-pressure-responsive 2-way valve are combined into a single unit. The electromagnetic valve is separate from the fuel injector.

11 Claims, 5 Drawing Sheets

COMMON-RAIL FUEL INJECTION SYSTEM FOR AN ENGINE

BACKGROUND OF THE INVENTION

1. Field of the Invention

This invention relates to a common-rail fuel injection system for an engine.

2. Description of the Related Art

Common-rail fuel injection systems for internal combustion engines such as diesel engines, include a high-pressure tubing which forms a pressure accumulator referred to as "a common rail". In general, the fuel injection systems of this type also include a high-pressure fuel supply pump for feeding high-pressure fuel to the common rail, and fuel-injection solenoid valves (fuel injectors) for selectively allowing the high-pressure fuel to flow from the common rail into engine cylinders.

In the case of automotive engines, the pressure of fuel injected into the engine cylinders has been increased to meet the emission regulations. The increased fuel injection pressure has necessitated an increase in the size of fuel-injection solenoid valves (fuel injectors).

However a compact engine arrangement, it is desirable to decrease the spaces occupied by fuel-injection solenoid valves (fuel injectors;). A region near an engine body or an engine block is required to accommodate various parts, such as inlet valves and outlet valves, of a system having a conventional configuration. Also, in this regard, it is desirable to decrease the spaces occupied by the fuel-injection solenoid valves (fuel injectors).

SUMMARY OF THE INVENTION

It is an object of this invention to provide an improved common-rail fuel injection system for an engine.

A first aspect of this invention provides a common-rail fuel injection system for an engine which comprises a fuel injector having a nozzle hole; a common rail storing high-pressure fuel and connected to the fuel injector to feed the high-pressure fuel thereto; a movable nozzle needle disposed in the fuel injector and blocking and unblocking the nozzle hole in accordance with the movement thereof; a back pressure control chamber defined in the fuel injector and connected to the common rail to receive the high-pressure fuel therefrom; means for urging the nozzle needle in a direction of so as to block the nozzle hole in response to a pressure in the back pressure control chamber; a fuel chamber defined in the fuel injector and connected to the common rail to receive the high-pressure fuel therefrom; means for urging the nozzle needle in a direction of so as to unblock the nozzle hole in response to the pressure in the fuel chamber; a fuel-pressure-responsive 2-way valve controlling the pressure in the back pressure control chamber; and an electromagnetic valve changing a state of the fuel-pressure-responsive 2-way valve; wherein the fuel injector and the fuel-pressure-responsive 2-way valve are combined into a single unit, and the electromagnetic valve is separate from the fuel injector.

A second aspect of this invention is based on the first aspect thereof, and provides a common-rail fuel injection system further comprising a high-pressure supply pump feeding the high-pressure fuel to the common rail, a primary pump feeding fuel to the high-pressure supply pump and the electromagnetic valve, and a distributing valve connected among the high-pressure supply pump, the primary pump, and the electromagnetic valve, wherein a control pressure for changing the state of the fuel-pressure-responsive 2-way valve is transmitted to the fuel-pressure-responsive 2-way valve from the primary pump via the distributing valve and the electromagnetic valve, and the control pressure corresponds to a pressure of the fuel fed to the high-pressure supply pump from the primary pump, and wherein the distributing valve holds substantially constant a ratio between a fuel pressure in the common rail and the pressure of the fuel fed to the high-pressure supply pump from the primary pump.

A third aspect of this invention is based on the first aspect thereof, and provides a common-rail fuel injection system wherein the fuel-pressure-responsive 2-way valve comprises a movable valve member urged in opposite directions by forces resulting from fuel pressures respectively, and means for substantially canceling the forces each other.

DESCRIPTION OF THE PREFERRED EMBODIMENTS

A conventional fuel injector (fuel injection valve) will be described hereinafter for better understanding this invention.

Figure 1:
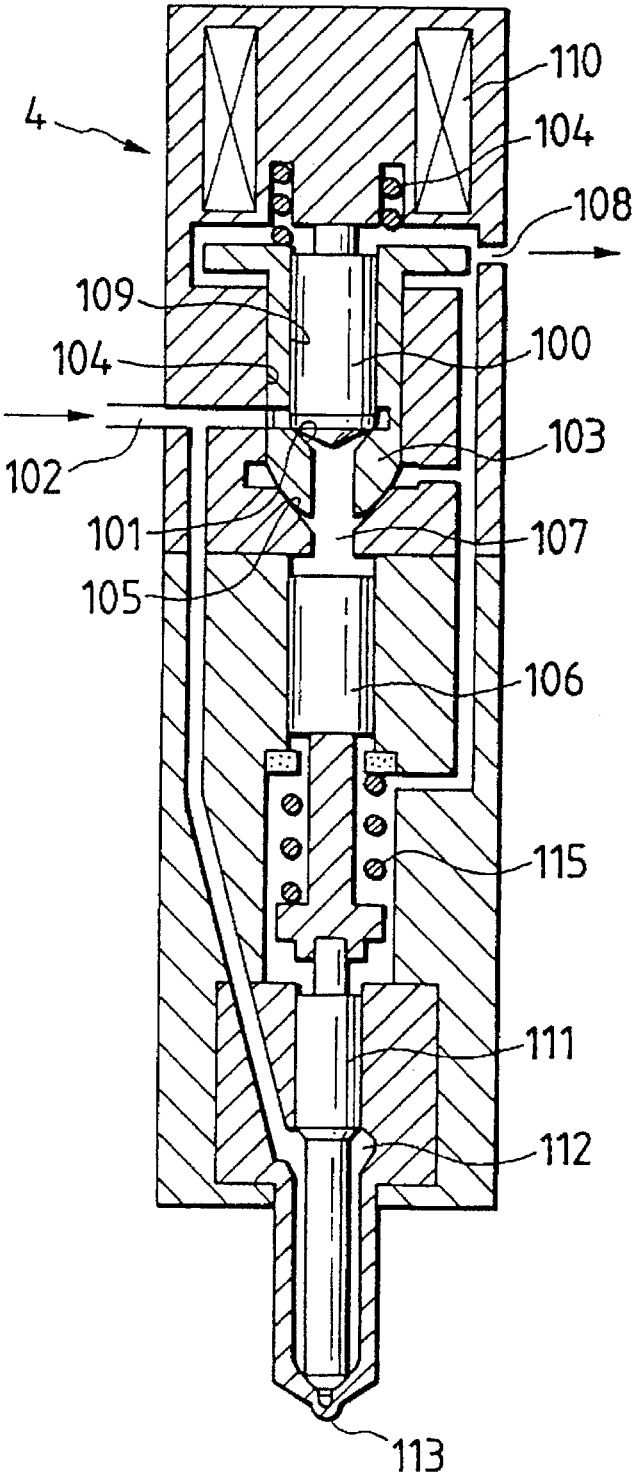
FIG. 1 PRIOR ART
FIG. 1 is a sectional view of a convention fuel injector.

Japanese published unexamined patent application 5-332220 relates to a fuel-pressure control valve for use in an engine fuel-injection system. FIG. 1 shows a prior-art fuel injector 4 of the three-way type which is disclosed in Japanese application 5-332220 as an example of the fuel-pressure control valve.

In FIG. 1, the prior-art fuel injector 4 includes an inner valve 100 in the form of a needle. The inner valve 100 is slidably disposed in a hollow outer valve 103. The inner valve 100 can move relative to the outer valve 103 in upward and downward directions as viewed in FIG. 1. The inner surfaces of the outer valve 103 form an inner valve seat 101 having a given diameter. The inner valve 100 can move into and out of contact with the inner valve seat 101.

The prior-art fuel injector 4 has a high-pressure port 102 supplied with high-pressure fuel. The high-pressure port 102 can communicate with a back pressure chamber 107. The communication between the high-pressure port 102 and the back pressure chamber 107 is established when the inner valve 100 separates from the inner valve seat 101. The communication between the high-pressure port 102 and the back pressure chamber 107 is blocked when the inner valve 100 falls into contact with the inner valve seat 101.

The prior-art fuel injector 4 has a body formed with an outer valve guide 114 in which the outer valve 103 is slidably disposed. The outer valve 103 can move relative to the outer valve guide 114 in upward and downward directions as viewed in FIG. 1. A spring 104 located in an upper portion of the prior-art fuel injector 4 urges the outer valve 103 toward an outer valve seat 105 formed in the fuel-injector body. The outer valve 103 can move into and out of contact with the outer valve seat 105. Normally, the outer valve 103 is pressed against the outer valve seat 105 by the spring 104.

The prior-art fuel injector 4 has a drain port 108 leading to a fuel tank. The drain port 108 can communicate with the back pressure chamber 107. The communication between the drain port 108 and the back pressure chamber 107 is established when the outer valve 103 separates from the outer valve seat 105. The communication between the drain port 108 and the back pressure chamber 107 is blocked when the outer valve 103 falls into contact with the outer valve seat 105.

The prior-art fuel injector 4 includes a command piston 106 having a cylindrical shape. The command piston 106 is moved downward by the pressure of fuel in the back pressure chamber 107. When the outer valve 103 moves upward and separates from the outer valve seat 105, the back pressure chamber 107 and the drain port 108 are made into communication with each other so that the pressure in the back pressure chamber 107 drops. The drop in the pressure within the back pressure chamber 107 causes the command piston 106 to move upward.

The inner valve 100 is slidably received by an inner valve guide 109 formed in the outer valve 103. The outer valve 103 is controlled by a solenoid 110 located within the fuel-injector body. Specifically, the outer valve 103 is attracted and moved upward by the solenoid 110 when the solenoid 110 is energized. A needle 111 fixed to the command piston 106 moves together with the latter. A fuel chamber 112 is continuously supplied with high-pressure fuel via the high-pressure port 102. The fuel chamber 112 can communicate with nozzle holes 113. The communication between the nozzle holes 113 and the fuel chamber 112 is established and blocked in accordance with movement of the needle 111. A spring 115 urges the needle 111 downward as viewed in FIG. 1.

The prior-art fuel injector 4 operates as follows. When a related engine is at rest, the pressure in the high-pressure port 102 is low and hence the inner valve 100 is held in its lowermost position by its weight. Thus, the inner valve 100 contacts the inner valve seat 101. When the related engine is started, high-pressure fuel is supplied to the high-pressure port 102. Lower end surfaces of the inner valve 100 are subjected to a high pressure of fuel via the high-pressure port 102 so that the inner valve 100 moves upward. On the other hand, the outer valve 103 is held in contact with the outer valve seat 105 by the force of the spring 104 provided that the solenoid 110 remains de-energized. Therefore, the inner valve 100 separates from the inner valve seat 101 in accordance with its upward movement. Thus, the high-pressure port 102 and the back pressure chamber 107 communicate with each other, and the back pressure chamber 107 is subjected to a high pressure. The high pressure in the back pressure chamber 107 urges the command piston 106 and the needle 111 downward. In addition, the spring 115 urges the needle 111 downward. As a result, the needle 111 assumes its lowermost position at which the nozzle holes 113 are blocked. Thus, fuel injection into an engine cylinder via the nozzle holes 113 does not occur.

When the solenoid 110 is energized, the outer valve 103 is attracted and moved upward thereby. Thus, the outer valve 103 separates from the outer valve seat 105. In addition, the inner valve seat 101 on the outer valve 103 meets the inner valve 100. Accordingly, the back pressure chamber 107 is disconnected from the high-pressure port 102 but is connected to the drain port 108. The connection between the back pressure chamber 107 and the drain port 108 causes a drop in the pressure within the back pressure chamber 107. On the other hand, the fuel chamber 112 remains supplied with high-pressure fuel via the high-pressure port 102. A high pressure of fuel in the fuel chamber 112 urges the needle 111 upward. Therefore, the needle 111 moves upward from its lowermost position against the force of the spring 115 so that the nozzle holes 113 are unblocked. Thus, fuel injection into the engine cylinder via the nozzle holes 113 occurs.

To meet the engine emission regulations, the pressure of fuel injected into the engine cylinder is generally set to a high level. Such a high level of fuel pressure requires the solenoid 110 to generate a strong attraction force, and hence the solenoid 110 tends to be large in size. Since the solenoid 110 is located within the fuel-injector body, the prior-art fuel injector 4 tends to be large in size.

First Embodiment

Figure 2:
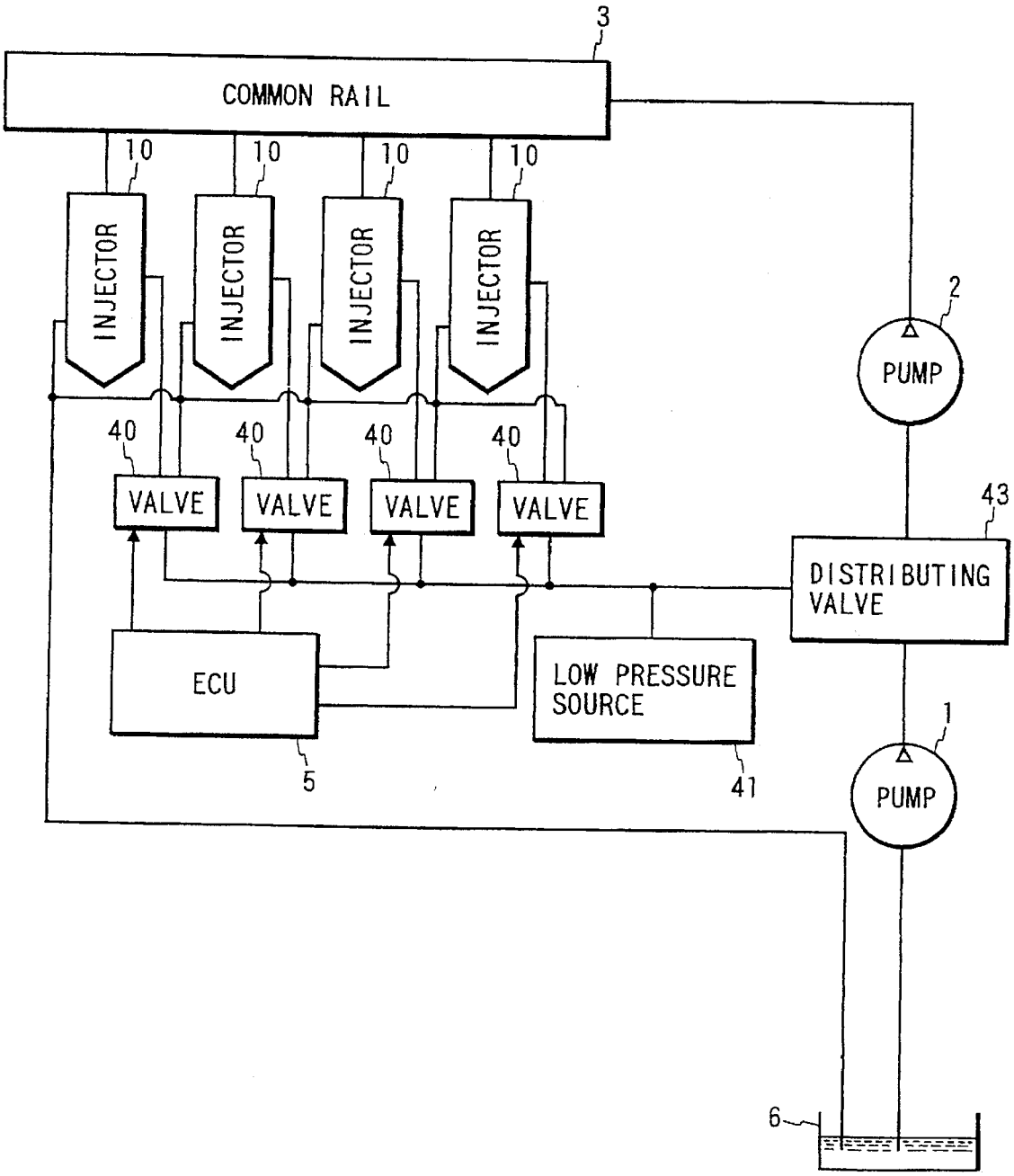
FIG. 2 is a diagram of a common-rail fuel injection system according to a first embodiment of this invention.

With reference to FIG. 2, a common-rail fuel injection system includes a primary pump 1 which draws fuel from a fuel tank 6. The primary pump 1 pressurizes the fuel, and increases the pressure of the fuel to a given low level. The primary pump 1 drives the fuel to a distributing valve 43. The distributing valve 43 feeds the fuel to a high-pressure supply pump 2 and also a chamber 41 providing a low-pressure source 41. The low-pressure source 41 stores low-pressure fuel fed from the primary pump 1.

The high-pressure supply pump 2 pressurizes the fuel, and increases the pressure of the fuel to a high pressure suited for fuel injection. The high-pressure supply pump 2 drives the fuel to a common rail 3. During operation of a related engine, high-pressure fuel is continuously fed from the high-pressure supply pump 2 to the common rail 3.

Fuel injectors 10 connected to the common rail 3 receive high-pressure fuel therefrom. The fuel injectors 10 serve to inject fuel into cylinders of the related engine respectively. Each of the fuel injectors 10 is changeable between an open state and a closed state. When the fuel injector 10 assumes the open state, fuel is injected into the related engine cylinder. When the fuel injector 10 assumes the closed state, fuel injection into the related engine cylinder is inhibited.

First ports of 3-way electromagnetic valves (3-way solenoid valves) 40 are connected to the fuel injectors 10 respectively. Second ports of the 3-way electromagnetic valves 40 are connected to the low-pressure source 41. Third ports of the 3-way electromagnetic valves 40 are connected to the fuel tank 6 via drain passages (no reference numeral). Further, the fuel injectors 10 are connected to the fuel tank 6 via drain passages (no reference numeral).

The 3-way electromagnetic valves 40 are electrically connected to an electronic control unit (ECU) 5. The 3-way electromagnetic valves 40 are controlled in response to output signals from the ECU 5. The ECU 5 includes drive circuits for the 3-way electromagnetic valves 40 respectively.

The fuel injectors 10 have similar structures. Accordingly, only one of the fuel injectors 10 will be described in detail.

Figure 3:
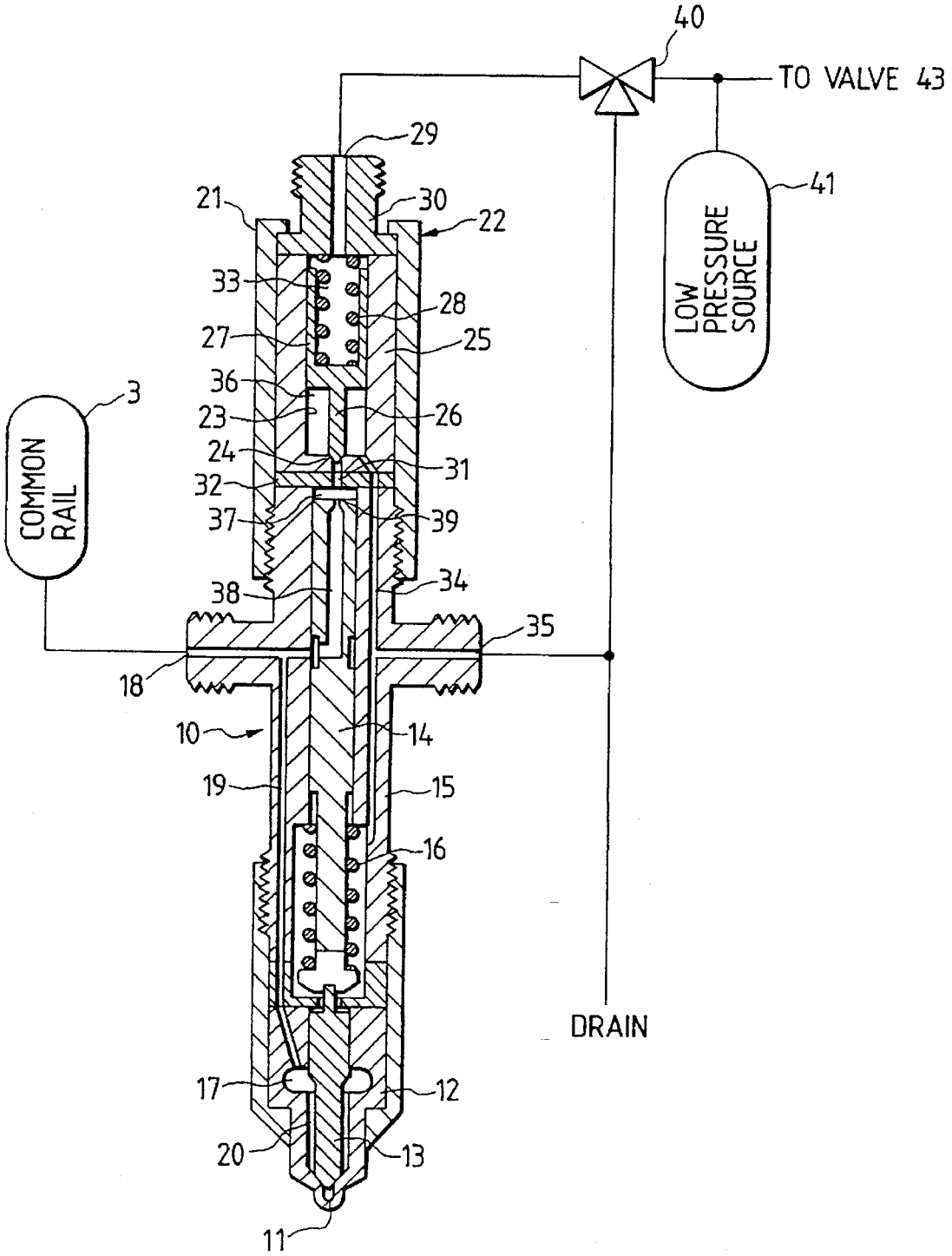
FIG. 3 is a diagram of a part of the common-rail fuel injection system of FIG. 2 which includes a sectional view of a unit having a fuel injector and a fuel-pressure-responsive 2-way valve.

As shown in FIG. 3, the fuel injector 10 includes a cylindrical nozzle body 12 having a lower end formed with a nozzle hole or holes 11. The nozzle body 12 has a central axial hole in which a nozzle needle 13 is slidably disposed.

The nozzle needle 13 can move relative to the nozzle body 12 in upward and downward directions as viewed in FIG. 3. When the nozzle needle 13 assumes its lowermost position, the nozzle hole or holes 11 are blocked. When the nozzle needle 13 moves from its lowermost position, the nozzle hole or holes 11 are unblocked.

The nozzle needle 13 is coaxially fixed to a command piston 14 having a cylindrical shape. The nozzle needle 13 moves together with the command piston 14. A fuel-injector body 15 in the form of a cylinder has a central axial bore in which the command piton 14 is slidably disposed. The fuel-injector body 15 and the nozzle body 12 are fixed to each other. The command piston 14 can move relative to the fuel-injector body 15 in upward and downward directions as viewed in FIG. 3. A spring 16 seated between a shoulder on the command piston 14 and a shoulder on the fuel-injector body 15 urges the command piston 14 and the nozzle needle 13 downward. The nozzle body 12 has a fuel chamber 17 through which the nozzle needle 13 extends. A step on the nozzle needle 13 is exposed to the fuel chamber 17. As will be made clear later, the fuel chamber 17 is supplied with high-pressure fuel. A high pressure of fuel in the fuel chamber 17 acts on the step of the nozzle needle 13, thereby urging the nozzle needle 13 upward.

The fuel-injector body 15 has a high-pressure port 18 supplied with high-pressure fuel from the common rail 3. The fuel-injector body 15 also has a high-pressure fuel passage 19 connecting the high-pressure fuel port 18 and the fuel chamber 17. A high-pressure fuel passage 20 located within the nozzle body 12 extends from the fuel chamber 17. The high-pressure fuel passage 20 is defined between walls of the nozzle body 12 and walls of the nozzle needle 13. The high-pressure fuel passage 20 can communicate with the nozzle hole or holes 11. When the nozzle needle 13 moves upward from its lowermost position and hence the nozzle hole or holes 11 are unblocked, high-pressure fuel is fed from the fuel chamber 17 to the nozzle hole or holes 11 via the high-pressure fuel passage 20. When the nozzle needle 13 falls into its lowermost position, the communication between the high-pressure fuel passage 20 and the nozzle hole or holes 11 is blocked so that the feed of high-pressure fuel to the nozzle hole or holes 11 is interrupted.

A 2-way valve (an ON/OFF valve) 22 responsive to a fuel pressure is attached to an upper end of the fuel-injector body 15. As will be made clear later, the fuel injector 10 and the 2-way valve 22 are combined into a single unit. The 2-way valve 22 includes an outer shell or nut 21 having a cylindrical shape coaxially screwed to the upper end of the fuel-injector body 15. The 2-way valve 22 also includes a cylindrical fixed body 25 coaxially disposed in the outer shell 21. The body 25 has a central axial bore providing a cylindrical valve guide 23. In addition, the body 25 has a closed lower end or bottom formed with a valve seat 24 at which a valve opening is located. A cylindrical valve member 27 is coaxially and slidably disposed in the valve guide 23. The valve member 27 can move relative to the body 25 in upward and downward directions as viewed in FIG. 3. A lower end of the valve member 27 has a needle 26. A lower end of the needle 26 can move into and out of contact with the valve seat 24. The valve opening at the valve seat 24 is blocked and unblocked when the needle 26 moves into and out of contact with the valve seat 24 respectively. An upper end of the outer shell 21 is closed by a fixed end member 30. A valve spring 28 seated between the valve member 27 and the end member 30 urges the needle 26 (the valve member 27) toward the valve seat 24. The end member 30 has a control port 29 subjected to a control fuel pressure. The control port 29 is connected to the first port of the 3-way electromagnetic valve 40 to receive the control fuel pressure therefrom. The control port 29 communicates with a control fuel pressure chamber 33 located within the body 25. The control fuel pressure chamber 33 extends at an upper side of the valve member 27. The control port 29 transmits the control fuel pressure to the control fuel pressure chamber 33. A disk spacer 32 held between the lower end of the body 25 and the upper end of the fuel-injector body 15 has a first orifice (a flow restriction) 31 in communication with the valve opening at the valve seat 24. A drain pressure chamber 36 located within the body 25 extends at a lower side of the valve member 27. The drain pressure chamber 36 is connected to the fuel tank 6 (see FIG. 2) via a drain passage 34 and a drain port 35. The drain passage 34 extends in walls of the body 25, walls of the spacer 32, and walls of the fuel-injector body 15. The drain port 35 extends in walls of the fuel-injector body 15.

A back pressure control chamber 37 is formed between the upper surface of the command piston 14 and the lower surface of the spacer 32. The back pressure control chamber 37 can communicate with the drain pressure chamber 36 via the first orifice 31 and the valve opening at the valve seat 24. The communication between the back pressure control chamber 37 and the drain pressure chamber 36 is established when the needle 26 separates from the valve seat 24. The communication between the back pressure control chamber 37 and the drain pressure chamber 36 is blocked when the needle 26 contacts the valve seat 24. The back pressure control chamber 37 continuously communicates with the high-pressure port 18 via a second orifice (a flow restriction) 39 and a high-pressure fuel passage 38. The second orifice 39 is defined by walls of the upper end of the command piston 14. The high-pressure fuel passage 38 extends in walls of the command piston 14. The communication between the back pressure control chamber 37 and the high-pressure port 18 remains maintained regardless of upward and downward movement of the command piston 14. The pressure of fuel in the back pressure control chamber 37 urges the command piston 14 and the nozzle needle 13 downward.

The 3-way electromagnetic valves 40 is formed as a separate device with respect to the fuel injector 10. This design enables a small size of the fuel injector 10, and provides a wide usable space near the body or block of the related engine. The control port 29 of the 2-way valve 22 is connected to the first port of the 3-way electromagnetic valves 40 via a fuel pipe (no reference numeral). A second port of the 3-way electromagnetic valve 40 is connected to the low-pressure source 41. A third port of the 3-way electromagnetic valves 40 is connected to the fuel tank 6 via a drain passage (no reference numeral). Also, the drain port 35 of the fuel injector 10 is connected to the fuel tank 6 via a drain passage (no reference numeral). The drain port 35 of the fuel injector 10 is connected to the third port of the 3-way electromagnetic valves 40. As previously described, the drain pressure chamber 36 within the 2-way valve 22 is connected to the fuel tank 6 (see FIG. 2) via the drain passage 34 and the drain port 35.

The 3-way electromagnetic valve 40 is changeable between a first position and a second position. When the 3-way electromagnetic valves 40 assumes its first position, the first port thereof is connected to the second port thereof but is disconnected from the third port thereof. Accordingly, in this case, the control port 29 of the 2-way valve 22 is connected to the low-pressure source 41 via the 3-way electromagnetic valves 40 so that the control port 29 receives the pressure in the low-pressure source 41 as the control fuel pressure. When the 3-way electromagnetic valves 40 assumes its second position, the first port thereof is connected to the third port thereof but is disconnected from the second port thereof. Accordingly, in this case, the control port 29 of the 2-way valve 22 is connected to the drain side (that is, the fuel tank 6) via the 3-way electromagnetic valves 40 so that the control port 29 receives the pressure at the drain side as the control fuel pressure.

As described previously, the ECU 5 (see FIG. 2) controls the 3-way electromagnetic valve 40. When fuel injection into the engine cylinder is required, the ECU 5 controls the 3-way electromagnetic valve 40 so that the control port 29 of the 2-way valve 22 will be connected to the drain side. Accordingly, in the 2-way valve 22, the pressure in the control fuel pressure chamber 33 drops. The needle 26 of the valve member 27 moves upward and unblocks the valve opening at the valve seat 24 in accordance with the drop in the pressure within the control fuel pressure chamber 33. When the valve opening at the valve seat 24 is unblocked, high-pressure fuel escapes from the back pressure control chamber 37 to the drain pressure chamber 36 via the first orifice 31 and the valve opening at the valve seat 24 so that the pressure in the back pressure control chamber 37 also drops. As a result, high-pressure fuel in the fuel chamber 17 lifts the nozzle needle 13 and the command piston 14 of the fuel injector 10 upward against the force of the spring 16. When the nozzle needle 13 moves upward from its lowermost position, the nozzle hole or holes 11 are opened. Thus, fuel is moved from the fuel chamber 17 into the nozzle hole or holes 11 before being injected into the engine cylinder via the nozzle hole or holes 11.

When suspension of fuel injection into the engine cylinder is required, the ECU 5 controls the 3-way electromagnetic valve 40 so that the control port 29 of the 2-way valve 22 will be connected to the low-pressure source 41. Accordingly, the pressure of fuel in the low-pressure source 41 is transmitted to the control fuel pressure chamber 33 in the 2-way valve 22 as the control fuel pressure. The needle 26 of the valve member 27 moves downward and blocks the valve opening at the valve seat 24 in accordance with the control fuel pressure within the control fuel pressure chamber 33. When the valve opening at the valve seat 24 is blocked, the escape of fuel from the back pressure control chamber 37 to the drain pressure chamber 36 is inhibited so that the pressure in the back pressure control chamber 37 rises due to the feed of high-pressure fuel to the back pressure control chamber 37 from the high-pressure port 18 via the second orifice 39. The rise in the pressure within the back pressure control chamber 37 forces the nozzle needle 13 and the command piston 14 of the fuel injector 10 downward against the pressure of fuel in the fuel chamber 17. When the nozzle needle 13 is forced into its lowermost position, the nozzle hole or holes 11 are blocked. Thus, fuel injection into the engine cylinder via the nozzle hole or holes 11 is suspended.

The back pressure control chamber 37 is supplied from the common rail 3 with a fuel pressure which varies in the range of, for example, 200 to 2,000 kgf/cm$^2$. The fuel pressure in the back pressure control chamber 37 acts on the valve seat 24. In the case where the diameter of the valve seat 24 is equal to 1 mm, the lower end of the needle 26 at the valve seat 24 is subjected to an upward force of 15.7 kgf when the pressure in the common rail 3 is equal to 2,000 kgf/cm$^2$. As previously described, when the 3-way electromagnetic valve 40 assumes its first position, the control fuel pressure is transmitted from the low-pressure source 41 to the control fuel pressure chamber 33 via the control port 29. The control fuel pressure applies a downward force to the upper surface of the valve member 27 of the 2-way valve 22. To hold the needle 26 of the valve member 27 in contact with the valve seat 24 against the above-indicated upward force, the resultant of the urging force of the valve spring 28 and the above-indicated downward fuel force applied to the upper surface of the valve member 27 (the force developed by fuel in the control fuel pressure chamber 33) is set greater than the above-indicated upward force.

To open the 2-way valve 22 even when the pressure in the common rail 3 is equal to 200 kgf/cm$^2$, the urging force of the valve spring 28 is set weaker than 1.57 kgf in the case where the diameter of the valve seat 24 is equal to 1 mm. When the outside diameter of the valve member 27 is equal to 8 mm, the control fuel pressure is set to 28 kgf/cm$^2$. This setting of the control fuel pressure enables the 2-way valve 22 to be closed even when the pressure in the common rail 3 is equal to 2,000 kgf/cm$^2$. As previously described, the control fuel pressure is transmitted from the low-pressure source 41 to the control fuel pressure chamber 33 via the control port 29. Since the pressure in the low-pressure source 41 is equal to the fuel feed pressure generated by the primary pump 1, the control fuel pressure originates from the fuel feed pressure generated by the primary pump 1.

Figure 4:
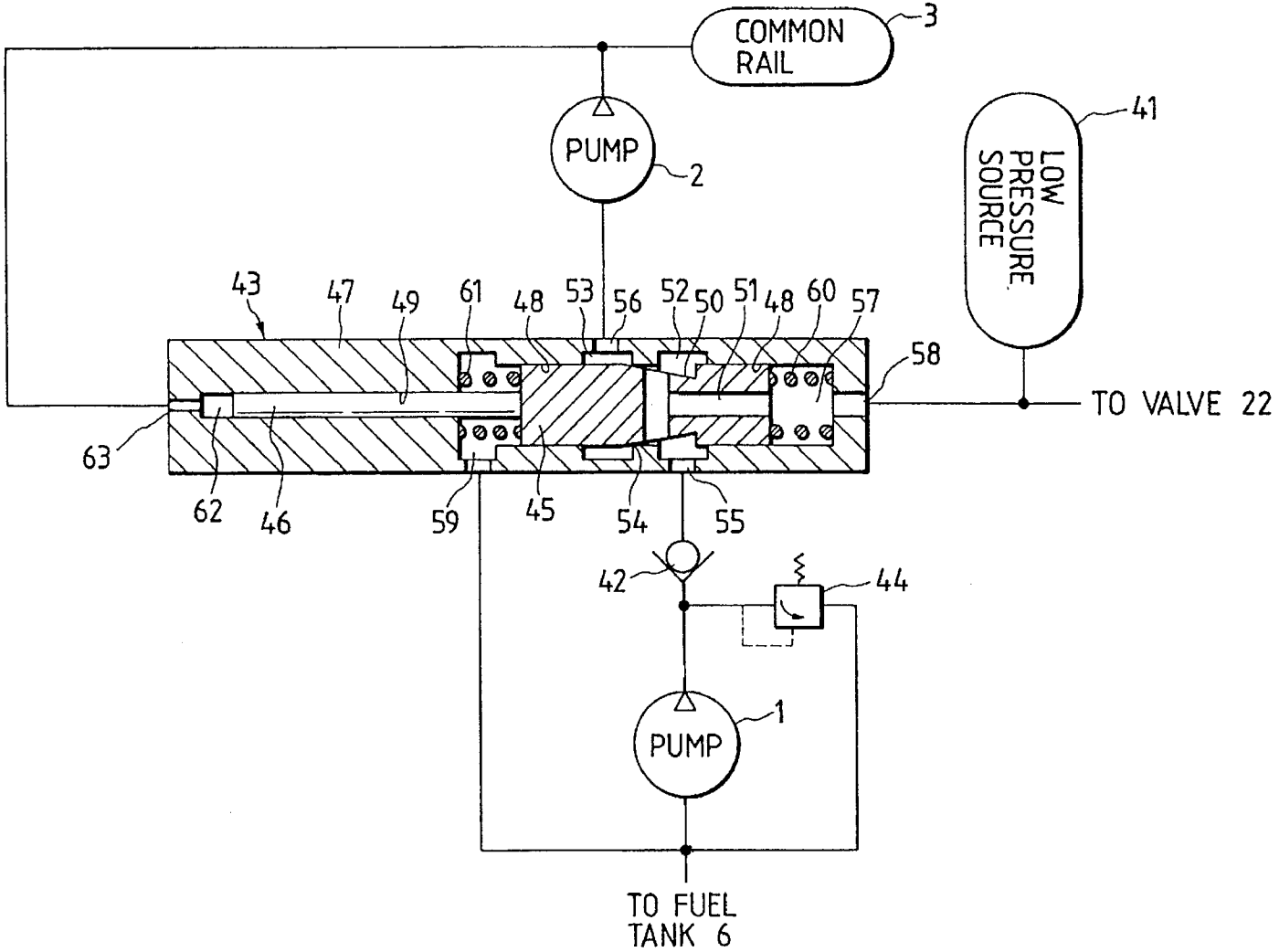
FIG. 4 is a diagram of a part of the common-rail fuel injection system of FIG. 2 which includes a sectional view of a distributing valve.

As shown in FIG. 4, the distributing valve 43 is interposed in a fuel passage extending between the primary pump 1 and the high-pressure supply pump 2. Further, a check valve 42 is connected between the primary pump 1 and the distributing valve 43. The outlet of the high-pressure supply pump 2 is connected to the common rail 3. A variable relief valve 44 connected between the outlet and the inlet of the primary pump 1 adjusts the pressure at the outlet thereof (that is, the discharge pressure developed by the primary pump 1).

The distributing valve 43 includes a movable valve member 45 having approximately a cylindrical shape. A rod 46 having a relatively-small diameter extends axially from the left-hand end of the valve member 45. The rod 46 is fixed to the valve member 45 so that the rod 46 moves together with the valve member 45. The distributing valve 43 has a body 47 formed with cylindrical guides 48 and 49 in which the valve member 45 and the rod 46 are slidably disposed.

As shown in FIG. 4, an intermediate part of the valve member 45 has a conical portion 50. A fuel hole 51 extending in the valve member 45 has one end exposed at the right-had end surface of the valve member 45 and other ends exposed at the conical portion 50 thereof. The inner surfaces of the body 47 have annular grooves providing an inlet chamber 52 and an outlet chamber 53 respectively. The inlet chamber 52 and the outlet chamber 53 extend around the conical portion 50 of the valve member 45. The inlet chamber 52 and the outlet chamber 53 are spaced from each other in the axial direction. The body 47 is provided with an annular valve seat 54 having a diameter smaller than the diameter of the guide 48. The valve seat 54 extends between the inlet chamber 52 and the outlet chamber 53. The body 47 has an inlet port 55 and an outlet port 56 which open into the inlet chamber 52 and the outlet chamber 53 respectively. The inlet port 55 is connected via the check valve 42 to the outlet of the primary pump 1. The outlet port 56 is connected to the inlet of the high-pressure supply pump 2.

As the valve member 45 moves rightward, the conical portion 50 of the valve member 45 contacts the valve seat 54 so that communication between the inlet chamber 52 and the outlet chamber 53 (that is, communication between the inlet port 55 and the outlet port 56) is blocked. Thereby, the feed of fuel from the primary pump 1 to the high-pressure supply pump 2 is interrupted. A low-pressure chamber 57 defined in the guide 48 extends at the right-hand end of the valve member 45. The low-pressure chamber 57 is connected to the low-pressure source 41 and the control port 22 of the 2-way valve 22 (see FIG. 3) via a low-pressure port 58 and a pipe (no reference numeral). The low-pressure port 58 extends through walls of the right-had end of the body 47. During operation of the related engine, the relatively-low fuel pressure developed by the primary pump 1 is continuously transmitted to the low-pressure source 41 since the low-pressure source 41 remains in communication with the outlet of the primary pump 1 via the low-pressure port 58, the low-pressure chamber 57, the fuel hole 51, the inlet port 55, and the check valve 42. A drain pressure chamber 59 defined in the guide 48 extends at the left-hand end of the valve member 45. The drain pressure chamber 59 is connected to the fuel tank 6.

Springs 60 and 61 are located in the low-pressure chamber 57 and the drain pressure chamber 59 respectively. The spring 60 urges the valve member 45 leftward relative to the body 47. The spring 61 urges the valve member 45 rightward relative to the body 47. A high-pressure chamber 62 defined in the guide 49 extends at the left-hand end of the rod 46. The body 47 has a high-pressure port 63 which opens into the high-pressure chamber 62. The high-pressure port 63 is connected to the common rail 63 and the outlet of the high-pressure supply pump 2. Accordingly, the high-pressure chamber 62 is subjected to the relatively-high pressure developed by the high-pressure supply pump 2. The pressure in the high-pressure chamber 62 urges the rod 46 and the valve member 45 rightward. The valve member 45 moves in accordance with the pressure in the high-pressure chamber 62. When the pressure in the high-pressure chamber 62 (that is, the discharge pressure developed by the high-pressure supply pump 2 or the fuel pressure in the common rail 3) is lower than a given pressure relative to discharge pressure developed by the primary pump 1, the conical portion 50 of the valve member 45 separates from the valve seat 54. Thus, in this case, the distributing valve 43 permits the feed of fuel from the primary pump 1 to the high-pressure supply pump 2. When the pressure in the high-pressure chamber 62 (that is, the discharge pressure developed by the high-pressure supply pump 2 or the fuel pressure in the common rail 3) is equal to or higher than the given pressure relative to the discharge pressure developed by the primary pump 1, the conical portion 50 of the valve member 45 is in contact with the valve seat 54. Thus, in this case, the distributing valve 43 inhibits the feed of fuel from the primary pump 1 to the high-pressure supply pump 2.

During operation of the related engine, until the pressure in the high-pressure chamber 62 (that is, the discharge pressure developed by the high-pressure supply pump 2 or the fuel pressure in the common rail 3) rises to the given pressure relative to the discharge pressure developed by the primary pump 1, the conical portion 50 of the valve member 45 separates from the valve seat 54. Thus, in this case, the distributing valve 43 permits the feed of fuel from the primary pump 1 to the high-pressure supply pump 2. Accordingly, the fuel pressure in the common rail 3 is enabled to further rise. When the pressure in the high-pressure chamber 62 (that is, the discharge pressure developed by the high-pressure supply pump 2 or the fuel pressure in the common rail 3) rises to or above the given pressure relative to the discharge pressure developed by the primary pump 1, the conical portion 50 of the valve member 45 contacts the valve seat 54. Thus, in this case, the distributing valve 43 inhibits the feed of fuel from the primary pump 1 to the high-pressure supply pump 2. The inhibition of the fuel feed causes a drop in the discharge pressure developed by the high-pressure supply pump 2 and also a drop in the pressure within the common rail 3. As a result, there occurs a decrease in the fuel pressure within the back pressure control chamber 37 of the fuel injector 10 which urges the needle 26 of the 2-way valve 22 upward.

In more detail, the low-pressure chamber 57 is subjected to the discharge pressure developed by the primary pump 1 (that is, the fuel feeding pressure to the high-pressure supply pump 2 or the control fuel pressure to the 2-way valve 22). The pressure in the low-pressure chamber 57 urges the valve member 45 leftward. On the other hand, the high-pressure chamber 62 is subjected to the discharge pressure developed by the high-pressure supply pump 2 (that is, the fuel pressure in the common rail 3). The pressure in the high-pressure chamber 62 urges the valve member 45 rightward. The position of the valve member 45 depends on the ratio between the pressure in the low-pressure chamber 57 and the pressure in the high-pressure chamber 62. When the pressure in the high-pressure chamber 62 increases relative to the pressure in the low-pressure chamber 57, the valve member 45 moves rightward so that a valve opening at the valve seat 54 narrows. Accordingly, in this case, the feed of fuel from the primary pump 1 to the high-pressure supply pump 2 is reduced. The reduction of the fuel feed to the high-pressure supply pump 2 results in a drop in the discharge pressure developed by the high-pressure supply pump 2 and also a drop in the pressure in the high-pressure chamber 62. When the pressure in the high-pressure chamber 62 falls relative to the pressure in the low-pressure chamber 57, the valve member 45 moves leftward so that the valve opening at the valve seat 54 widens. Accordingly, in this case, the feed of fuel from the primary pump 1 to the high-pressure supply pump 2 is increased. The increase in the fuel feed to the high-pressure supply pump 2 results in a rise in the discharge pressure developed by the high-pressure supply pump 2 and also a rise in the pressure in the high-pressure chamber 62. In this way, the distributing valve 43 controls the fuel feed from the primary pump 1 to the high-pressure supply pump 2 so as to hold approximately constant the ratio between the fuel pressure in the common rail 3 and the fuel feeding pressure to the high-pressure supply pump 2 (that is, the control fuel pressure to the 2-way valve 22).

As previously described, in the case where the outside diameter of the valve member 27 is equal to 8 mm and the diameter of the valve seat 24 is equal to 1 mm, the control fuel pressure applied to the 2-way valve 22 from the low-pressure source 41 is set to 28 $kgf/cm^2$ to enable the 2-way valve 22 to be closed even when the pressure in the common rail 3 is equal to 2,000 $kgf/cm^2$. The ratio between the cross-sectional area of the rod 46 and the cross-sectional area of the valve seat 54 corresponds to a fuel distribution ratio provided by the distributing valve 43. The ratio between the cross-sectional area of the rod 46 and the cross-sectional area of the valve seat 54 is preferably set as 28:2,000. In this case, the valve member 27 of the 2-way valve 22 can stably operate even when the fuel pressure in the common rail 3 varies between 200 $kgf/cm^2$ and 2,000 $kgf/cm^2$.

Second Embodiment

A second embodiment of this invention is similar to the embodiment of FIGS. 2–4 except that a 2-way valve (an ON/OFF valve) 22' responsive to a fuel pressure replaces the 2-way valve 22 (see FIG. 3). The 2-way valve 22' agrees with a slight modification of the 2-way valve 22.

Figure 5:
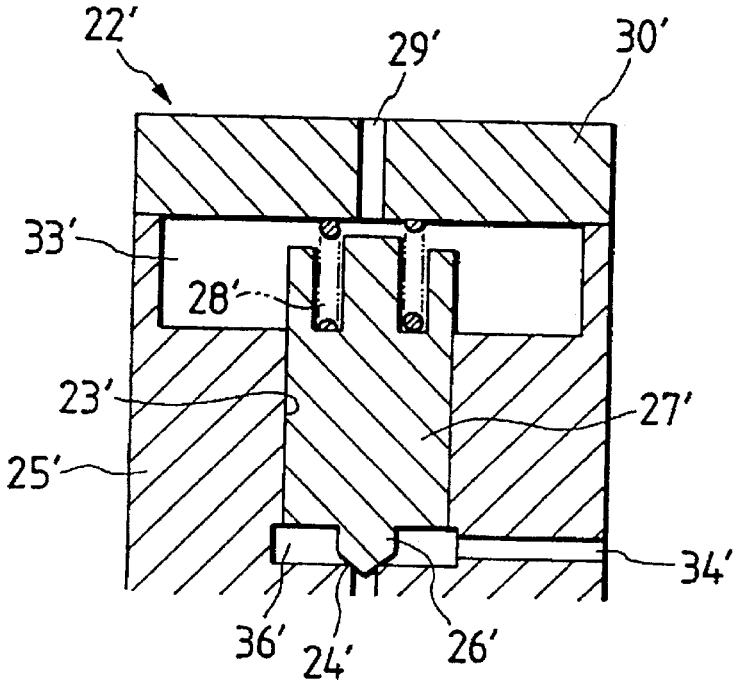
FIG. 5 is a sectional view of a fuel-pressure-responsive 2-way valve in a common-rail fuel injection system according to a second embodiment of this invention.

As shown in FIG. 5, the 2-way valve 22' includes a cylindrical body 25' which has a central axial bore providing a cylindrical valve guide 23'. In addition, the body 25' has a closed lower end or bottom formed with a valve seat 24' at which a valve opening is located. A cylindrical valve member 27' is coaxially and slidably disposed in the valve guide 23'. The valve member 27' can move relative to the body 25' in upward and downward directions as viewed in FIG. 5. A lower end of the valve member 27' has a needle 26'. A lower end of the needle 26' can move into and out of contact with the valve seat 24'. The valve opening at the valve seat 24' is blocked and unblocked when the needle 26' moves into and out of contact with the valve seat 24' respectively. An upper end of the body 25' is closed by an end member 30'. A valve spring 28' seated between the valve member 27' and the end member 30' urges the needle 26' (the valve member 27') toward the valve seat 24'. Specifically, the upper end surfaces of the valve member 27' are formed with an annular groove which accommodates a lower part of the valve spring 28'. The end member 30' has a control port 29' subjected to a control fuel pressure. The control port 29' communicates with a control fuel pressure chamber 33' located within the body 25'. The control fuel pressure chamber 33' extends at an upper side of the valve member 27'. The control port 29' transmits the control fuel pressure to the control fuel pressure chamber 33'. A drain pressure chamber 36' located within the body 25' extends at a lower side of the valve member 27'. The drain pressure chamber 36' is connected to a fuel tank 6 (see FIG. 2) via a drain passage 34' which extends in walls of the body 25'.

Third Embodiment

A third embodiment of this invention is similar to the embodiment of FIGS. 2–4 except that a 2-way valve (an ON/OFF valve) 22" responsive to a fuel pressure replaces the 2-way valve 22 (see FIG. 3), and that the distributing valve 43 (see FIGS. 2 and 4) is omitted. In the third embodiment, the outlet of a primary pump 1 (see FIG. 2) is directly connected to the inlet of a high-pressure supply pump 2 (see FIG. 2) and a low-pressure source 41 (see FIG. 2).

Figure 6:
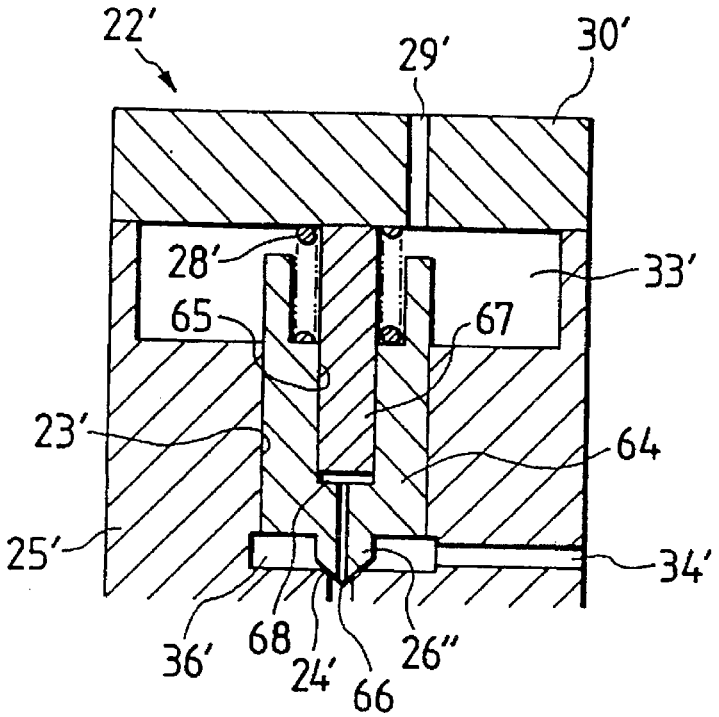
FIG. 6 is a sectional view of a fuel-pressure-responsive 2-way valve in a common-rail fuel injection system according to a third embodiment of this invention.

As shown in FIG. 6, the 2-way valve 22" includes a cylindrical body 25' which has a central axial bore providing a cylindrical valve guide 23'. In addition, the body 25' has a closed lower end or bottom formed with a valve seat 24' at which a valve opening is located. A cylindrical valve member 64 is coaxially and slidably disposed in the valve guide 23'. The valve member 64 can move relative to the body 25' in upward and downward directions as viewed in FIG. 6. A lower end of the valve member 64 has a needle 26". A lower end of the needle 26" can move into and out of contact with the valve seat 24'. The valve opening at the valve seat 24' is blocked and unblocked when the needle 26" moves into and out of contact with the valve seat 24' respectively. An upper end of the body 25' is closed by an end member 30'. A valve spring 28' seated between the valve member 64 and the end member 30' urges the needle 26" (the valve member 64) toward the valve seat 24'. Specifically, the upper end surfaces of the valve member 64 are formed with a recess which accommodates a lower part of the valve spring 28'. The end member 30' has a control port 29' subjected to a control fuel pressure. The control port 29' communicates with a control fuel pressure chamber 33' located within the body 25'. The control fuel pressure chamber 33' extends at an upper side of the valve member 64. The control port 29' transmits the control fuel pressure to the control fuel pressure chamber 33'. A drain pressure chamber 36' located within the body 25' extends at a lower side of the valve member 64. The drain pressure chamber 36' is connected to a fuel tank 6 (see FIG. 2) via a drain passage 34' which extends in walls of the body 25'.

The valve member 64 is formed with a coaxial central hole 65 having a bottom. A lower portion or a bottom portion of the central hole 65 communicates with the valve opening at the valve seat 24' via a small-diameter hole 66 which axially extends through the needle 26" and a lower portion of the valve member 64. A balance rod 67 extends into the central hole 65 of the valve member 64. The valve member 64 can slide axially relative to the balance rod 67. A free end or an upper end of the balance rod 67 contacts the end member 30'. The upper end of the balance rod 67 may be fixed to the end member 30'. A balance pressure chamber 68 defined in a bottom portion of the central hole 65 extends at a lower end of the balance rod 67. The balance rod 67 serves as a piston.

A pressure in a back pressure control chamber 37 (see FIG. 3) is transmitted to the balance pressure chamber 68 via a first orifice 31 (see FIG. 3) and the small-diameter hole 66. Accordingly, a pressure developed in the balance pressure chamber 68 is close to the pressure in the back pressure control chamber 37 (see FIG. 3). The pressure in the balance pressure chamber 68 urges the needle 26" and the valve member 64 downward. Also, the pressure in the back pressure control chamber 37 (see FIG. 3) is transmitted to the valve opening at the valve seat 24'. The pressure in the valve opening at the valve seat 24' urges the needle 26" and the valve member 64 upward. Since both the pressure in the balance pressure chamber 68 and the pressure in the valve opening at the valve seat 24' originate from the pressure in the back pressure control chamber 37 (see FIG. 3), there continuously occurs a balanced relation between a downward force and an upward force to the needle 26" (the valve member 64) which are caused by the pressure in the balance pressure chamber 68 and the pressure in the valve opening at the valve seat 24' respectively. Accordingly, even when the pressure in the back pressure control chamber 37 remarkably rises in accordance with an increase in the fuel pressure within a common rail 3 (see FIG. 2), a difference between the downward force and the upward force to the needle 26" (the valve member 64) is prevented from unacceptably increasing. Thus, even when the fuel pressure within the common rail 3 (see FIG. 2) becomes very high, a relatively-low level of the control fuel pressure supplied to the control port 29' suffices. Therefore, the needle 26" and the valve member 64 can continuously operate in stable conditions. Further, it is possible to omit the distributing valve 43 (see FIGS. 2 and 4) which adjusts the control fuel pressure relative to the fuel pressure in the common rail 3 (see FIG. 2).

In the case where the diameter of the balance rod 67 and the diameter of the valve seat 24' are approximately equal to each other, the previously-indicated downward force and the previously-indicated upward force to the needle 26" (the valve member 64) substantially cancel each other. Accordingly, in this case, the control fuel pressure can be equal to a relatively-low constant value.

It is preferable that the diameter of the balance rod 67 is slightly smaller than the diameter of the valve sea 24'. In this case, a resultant of the previously-indicated downward force and the previously-indicated upward force to the needle 26" (the valve member 64) agrees with an upward weak force. Further, the control fuel pressure supplied to the control port 29' from the low-pressure source 41 (see FIG. 2) is designed to apply a downward force to the needle 26" (the valve member 64) which balances the above-indicated upward weak force. This designing enables the needle 26" to be in contact with the valve seat 24' even when the fuel pressure in the common rail 3 (see FIG. 2) is maximized. In addition, a relatively-low level of the control fuel pressure suffices.

What is claimed is:

1. A common-rail fuel injection system for an engine, comprising:

a fuel injector having a nozzle hole;

a common rail storing high-pressure fuel and connected to the fuel injector to feed the high-pressure fuel thereto;

a movable nozzle needle disposed in the fuel injector, and blocking and unblocking the nozzle hole in accordance with movement of the nozzle needle;

a back pressure control chamber defined in the fuel injector and communicating with the common rail to receive the high-pressure fuel therefrom;

means for urging the nozzle needle in the direction so as to block the nozzle hole in response to a pressure in the back pressure control chamber;

a fuel chamber defined in the fuel injector and communicating with the common rail to receive the high-pressure fuel therefrom;

means for urging the nozzle needle in a direction so as to unblock the nozzle hole in response to a pressure in the fuel chamber;

a fuel-pressure-responsive 2-way valve controlling the pressure in the back pressure control chamber; and an electromagnetic valve selectively changing a state of the fuel-pressure-responsive 2-way valve;

wherein the fuel injector and the fuel-pressure-responsive 2-way valve are combined into a single unit, and the electromagnetic valve is separate from the fuel injector; and wherein the fuel-pressure-responsive 2-way valve comprises a valve body connected to the fuel injector, a communication passage defined in the valve body and communicating with the back pressure control chamber, a control port defined in the valve body and receiving a control pressure via the electromagnetic valve to control a pressure at the control port, a valve member movably disposed in the valve body for selectively opening and closing the communication passage in response to a pressure from the control port, and pressure applying means for applying a pressure, which is approximately equal to a pressure within the communication passage, to the valve member in a direction so as to close the communication passage.

2. The common-rail fuel injection system of claim 1, further comprising a high-pressure supply pump providing the high-pressure fuel to the common rail, a primary pump providing fuel to the high-pressure supply pump and the electromagnetic valve, and a distributing valve connected to the high-pressure supply pump, the primary pump, and the electromagnetic valve, wherein a control pressure for changing the state of the fuel-pressure-responsive 2-way valve is transmitted to the fuel-pressure-responsive 2-way valve from the primary pump via the distributing valve and the electromagnetic valve, and the control pressure corresponds to a pressure of the fuel fed to the high-pressure supply pump from the primary pump, and wherein the distributing valve holds a substantially constant a ratio between a fuel pressure in the common rail and the pressure of the fuel fed to the high-pressure supply pump from the primary pump.

3. A common-rail fuel injection system as recited in claim 1, wherein the valve body has a valve guide located between the communication passage and the control port, the valve member slidably fitting in the valve guide, the valve member having a needle portion for selectively blocking and unblocking the communication passage, the pressure applying means having a balance pressure chamber formed in the needle portion, and wherein a pressure in the balance pressure chamber is set approximately equal to a pressure in the communication passage.

4. A common-rail fuel injection system as recited in claim 3, further comprising a balance rod slidably fitting into the balance pressure chamber, the balance rod having an end contacting the valve body.

5. A common-rail fuel injection system as recited in claim 4, wherein the communication passage has a contact portion forming a seat portion for the needle portion, and wherein a diameter of the seat portion is approximately equal to a diameter of the balance rod.

6. A common-rail fuel injection system as recited in claim 4, wherein the communication passage has a contact portion forming a seat portion for the needle portion, and wherein a diameter of the balance rod is smaller than a diameter of the seat portion, and further comprising a spring for urging the balance rod toward the seat portion.

7. A common-rail fuel injection system for an engine, comprising:

a fuel injector having a nozzle hole;

a common rail storing high-pressure fuel and connected to the fuel injector to feed the high-pressure fuel thereto;

a movable nozzle needle disposed in the fuel injector, and blocking and unblocking the nozzle hole in accordance with movement of the nozzle needle;

a back pressure control chamber defined in the fuel injector and communicating with the common rail to receive the high-pressure fuel therefrom;

means for urging the nozzle needle in a direction so as to block the nozzle hole in response to a pressure in the back pressure control chamber;

a fuel chamber defined in the fuel injector and communicating with the common rail to receive the high-pressure fuel therefrom;

means for urging the nozzle needle in a direction so as to unblock the nozzle hole in response to a pressure in the fuel chamber;

a fuel-pressure-responsive 2-way valve controlling the pressure in the back pressure control chamber; and an electromagnetic valve selectively changing a state of the fuel-pressure-responsive 2-way valve;

wherein the fuel injector and the fuel-pressure-responsive 2-way valve are combined into a single unit, and the electromagnetic valve is separate from the fuel injector; and wherein the fuel-pressure-responsive 2-way valve comprises a valve body connected to the fuel injector, a first communication passage defined in the valve body and communicating with the back pressure control chamber, a control port defined in the valve body and receiving a control pressure via the electromagnetic valve to control pressure at the control port, a valve guide formed in the valve body and located between the first communication passage and the control port, a valve member slidably fitting in the valve guide, a needle portion contained in the valve member for selectively blocking and unblocking the first communication passage, a second communication passage defined in the needle portion, a hole formed in the valve member and communicating with the second communication passage, the needle portion being urged in a direction so as to block the first communication passage, a balance rod slidably fitting into the hole in the valve member, and a balance pressure chamber formed in the hole in the valve member and defined by an end of the balance rod, wherein a pressure in the balance pressure chamber urges the valve member in a direction so as to close the first communication passage.

8. A common-rail fuel injection system as recited in claim 7, further comprising a high-pressure supply pump providing the high-pressure fuel to the common rail, a primary pump providing fuel to the high-pressure supply pump and the electromagnetic valve, and a distributing valve connected to the high-pressure supply pump, the primary pump, and the electromagnetic valve, wherein a control pressure for changing the state of the fuel-pressure-responsive 2-way valve is transmitted to the fuel-pressure-responsive 2-way valve from the primary pump via the distributing valve and the electromagnetic valve, and the control pressure corresponds to a pressure of the fuel fed to the high-pressure supply pump from the primary pump, and wherein the distributing valve holds a substantially constant a ratio between a fuel pressure in the common rail and the pressure of the fuel fed to the high-pressure supply pump from the primary pump.

9. A common-rail fuel injection system as recited in claim 7, wherein the balance rod has an end contacting the valve body.

10. A common-rail fuel injection system as recited in claim 7, wherein the first communication passage has a contact portion forming a seat portion for the needle portion, and wherein a diameter of the seat portion is approximately equal to a diameter of the balance rod.

11. A common-rail fuel injection system as recited in claim 7, wherein the communication passage has a contact portion forming a seat portion for the needle portion, and wherein a diameter of the balance rod is smaller than a diameter of the seat portion, and further comprising a spring for urging the balance rod toward the seat portion.

* * * * *